US010537157B2

(12) United States Patent
Partheban et al.

(10) Patent No.: US 10,537,157 B2
(45) Date of Patent: Jan. 21, 2020

(54) ERGONOMIC WRISTBAND WITH DEVICE SUPPORT MEANS

(71) Applicants: Vallipuram Balendran Partheban, Purley (GB); Siveda Partheban, Purley (GB)

(72) Inventors: Vallipuram Balendran Partheban, Purley (GB); Siveda Partheban, Purley (GB)

( * ) Notice: Subject to any disclaimer, the term of this patent is extended or adjusted under 35 U.S.C. 154(b) by 0 days.

(21) Appl. No.: 14/912,246

(22) PCT Filed: Aug. 14, 2014

(86) PCT No.: PCT/GB2014/000314
§ 371 (c)(1),
(2) Date: Feb. 16, 2016

(87) PCT Pub. No.: WO2015/022479
PCT Pub. Date: Feb. 19, 2015

(65) Prior Publication Data

US 2016/0192744 A1 Jul. 7, 2016

(30) Foreign Application Priority Data

Aug. 14, 2013 (GB) ..... 1314525.5

(51) Int. Cl.
*A44C 5/00* (2006.01)

(52) U.S. Cl.
CPC ..... *A44C 5/0053* (2013.01)

(58) Field of Classification Search
CPC ..... A44C 5/00; G04B 37/1486; G04G 17/00
USPC ..... 224/164
See application file for complete search history.

(56) References Cited

U.S. PATENT DOCUMENTS 1,407,239 A * 2/1922 Weiss ..... B42D 5/006 108/43
1,453,671 A * 5/1923 Harrold ..... A44C 5/0046 224/267
2,187,205 A 1/1940 Katz
2,226,138 A 12/1940 Eugen
2,473,226 A * 6/1949 Sheldon ..... G04B 37/12 132/301
2,590,572 A 3/1952 Rasmussen
3,375,958 A 4/1968 Cooper
4,473,969 A * 10/1984 Wilson ..... A63H 17/44 224/219
4,575,833 A * 3/1986 Bakhtiari ..... G04B 37/0058 368/282
4,879,702 A 11/1989 Gardner
(Continued)

FOREIGN PATENT DOCUMENTS

FR 2250269 5/1975
FR 2617614 1/1989
(Continued)

*Primary Examiner* — Brian D Nash
(74) *Attorney, Agent, or Firm* — Thomas | Horstemeyer, LLP; Jason M. Perilla

(57) ABSTRACT

A wristband assembly for supporting a device on a wrist, the wristband assembly comprising: a wristband; fastening means to releasably secure the device to the wristband; and at least one distal forearm engaging portion to mount the fastening means over an inner wrist bone of the wrist, whereby the fastening means is configured to mount the device to the wristband and onto the side of the wrist.

17 Claims, 8 Drawing Sheets

(56) References Cited

U.S. PATENT DOCUMENTS

| | | | | |
|---|---|---|---|---|
| 5,068,840 | A | 11/1991 | Buckner | |
| 5,899,370 | A * | 5/1999 | Bould | A44C 5/0053 224/164 |
| 6,321,957 | B1 * | 11/2001 | Rossi | A01K 27/006 206/811 |
| 7,307,921 | B1 | 12/2007 | Karterman | |
| 8,016,492 | B2 * | 9/2011 | Pyle | G03B 17/00 224/222 |
| 2003/0099162 | A1 * | 5/2003 | Field | A44C 5/0053 368/281 |
| 2009/0321483 | A1 * | 12/2009 | Froloff | A45F 5/00 224/267 |
| 2013/0020367 | A1 * | 1/2013 | Buckley | A63B 57/353 224/584 |

FOREIGN PATENT DOCUMENTS

| | | |
|---|---|---|
| GB | 423470 | 2/1935 |
| GB | 1249078 | 10/1971 |
| GB | 2406921 | 4/2005 |
| JP | S576380 | 1/1982 |
| WO | 9012347 | 10/1990 |

* cited by examiner

ERGONOMIC WRISTBAND WITH DEVICE SUPPORT MEANS

CROSS REFERENCE TO RELATED APPLICATIONS

This application is the national stage application under 35 U.S.C. § 371 of International Application No. PCT/GB2014/000314, filed Aug. 14, 2015 and claims priority under 35 U.S.C. § 119 to Great Britain Application No. 1314525.5, filed Aug. 14, 2013. All of these documents are incorporated by reference herein in their entireties.

FIELD OF THE INVENTION

The present invention is concerned with improvements in or relating to an ergonomic wristband and is particularly concerned with improvements in an ergonomic wristband that is configured to support a device, wherein the device is positioned overlying an inner wrist bone of a wearer so that the device is readily accessible to a wearer.

BACKGROUND OF THE INVENTION

The positioning of a device when mounted on a wrist so that it is easily viewed by an athlete, pilot or, indeed, anyone who finds themselves in a cramped position on public transport, for example, is not in itself novel and there have been several proposals, as evidenced by the prior art, for overcoming the problem of being unable to view a device such as a wristwatch without turning ones wrist through 90 degrees.

The prior art includes U.S. Pat. No. 5,068,840, which discloses a mounting for an instrument, the mounting being configured so that the instrument is positioned overlying the inner side of the wearer's wrist bone. However, the mounting is spaced from the wearer's wrist by a molding of resilient material that is shaped to conform to the wearer's wrist. The provision of a specially shaped molding adds to the complexity and cost of producing like products for other individuals, whose wrist bones are of different contours and shapes.

U.S. Pat. No. 2,226,138 discloses a wristwatch that is of curved configuration so that it may be worn against the inner side of a wearer's wrist. No provision appears to have been made for the comfort of the wearer in that there is no padding provided between the wristwatch and the wearer's wrist.

U.S. Pat. No. 2,590,572 discloses two bracelet mountings for a wristwatch, the first of which is a split band made from resilient plastic material with a wristwatch enclosed in a side portion thereof, and a second modified band that is provided with hinged portions for closing the band about the wrist of a wearer. Both mountings are provided with means for encapsulating a wristwatch between inner and outer portions of the bracelet mountings leading to a complexity of construction.

Other disclosures include U.S. Pat. No. 3,375,958 that teaches the use of a curved mounting for a conventional wristwatch, the curved mounting is made from metal sheet and does not have provision for cushioning the mounting that sits against the side of a wearer's wrist. This mounting does not support other devices.

SUMMARY OF THE INVENTION

Therefore, it is an object of the present invention to overcome, or at least mitigate, the disadvantages of the prior art proposals.

Thus, the present invention conveniently provides a wristband assembly whereby, in use, a device is located over the inner wrist bone of a wearer enabling the wearer to view and access the device without turning their hand through approximately 90 degrees, characterised in that the wristband assembly comprises a wristband as hereinbefore defined, which wristband comprises a wrist engaging portion provided with an aperture for mounting a device.

According to one aspect of the present invention, there is provided a wristband assembly for supporting a device on a wrist, the wristband assembly comprising:

a wristband;

fastening means to releasably secure the device to the wristband; and at least one distal forearm engaging portion to mount the fastening means over an inner wrist bone of the wrist, whereby the fastening means is configured to mount the device to the wristband and onto the side of the wrist.

Preferably, the fastening means comprises at least one latching element, configured to engage with the device.

The fastening means may comprise an aperture characterised in that an inner peripheral edge of the lower peripheral wall is flexible so that, when the device is inserted between the upper and lower peripheral walls, the inner peripheral edge of the lower peripheral wall is deformed to allow passage of the device into a spatial volume defined between the upper and lower peripheral walls.

Preferably, the distal forearm engaging portion and the wristband are formed as one piece.

The fastening means may be configured to support any one of the following devices: wristwatch, mobile phone, smartphone, Personal Digital Assistant, MP3 player, GPS or similar small device.

The fastening means may be configured to allow the devices to be interchangeable.

Preferably, the wristband and/or distal forearm engaging portion are formed from a silicone rubber.

The silicone rubber may be polysiloxane.

The fastening means may be configured to support a conventional wristwatch.

The wristband may comprise a parallel double-strap arrangement, and each strap may incorporate a distal forearm engaging portion and a fastening means configured to allow for a device of greater length to be supported on the side of the wrist.

The fastening means may incorporate at least one aperture for accessing the controls on the device.

The fastening means may incorporate a cover, for covering the surface of the device when releasably secured to the fastening means, preventing accidental use.

BRIEF DESCRIPTION OF THE DRAWINGS

Said cover may comprise a window.

The cover may be hingedly secured to the fastening means.

Figure 1:
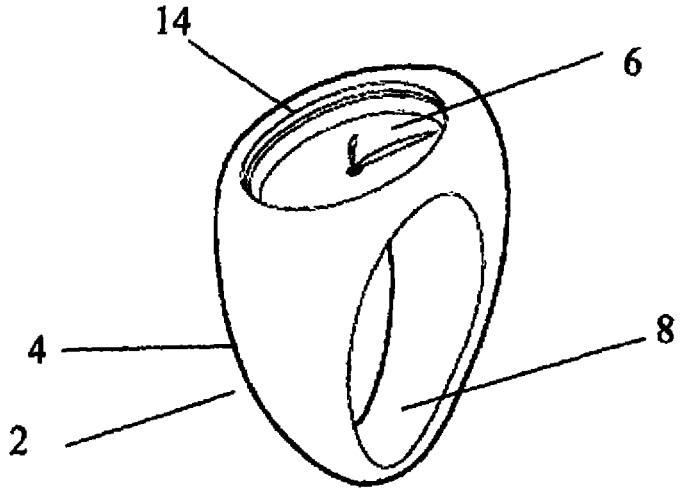
Figure 2:
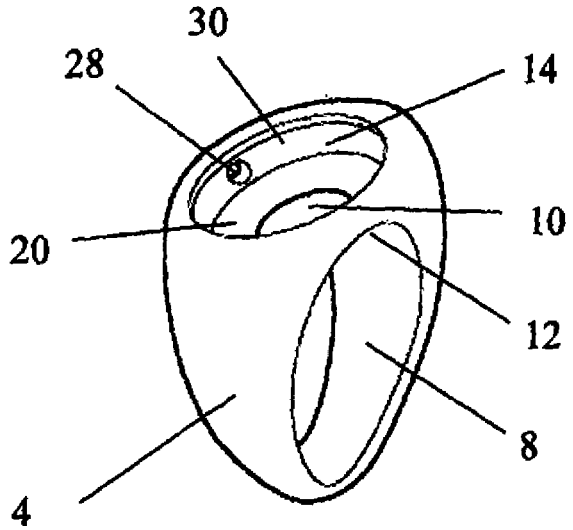
Figure 3:
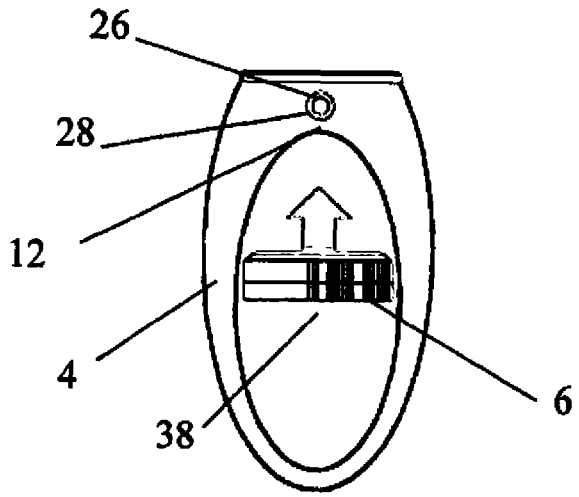
Figure 4:
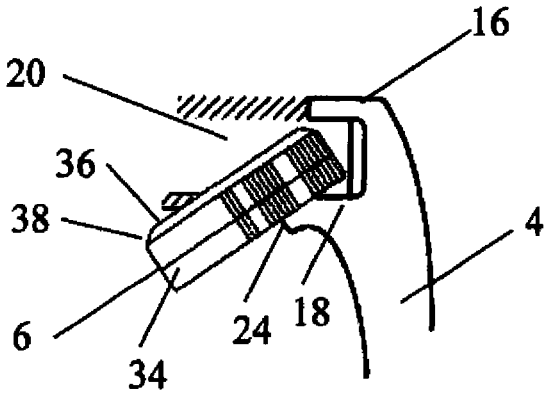
Figure 5:
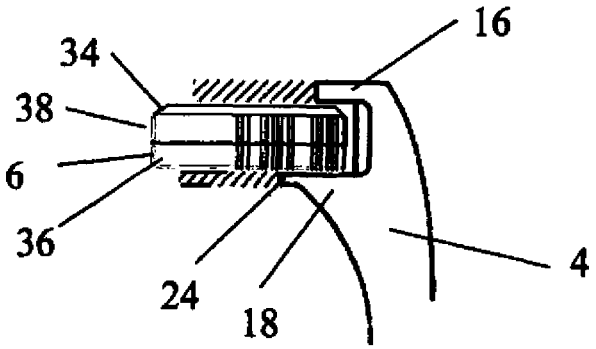
Figure 6:
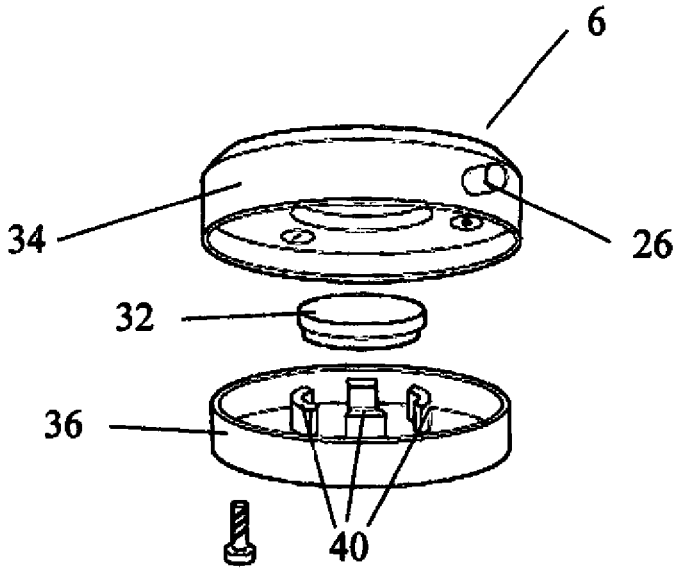
Figure 7:
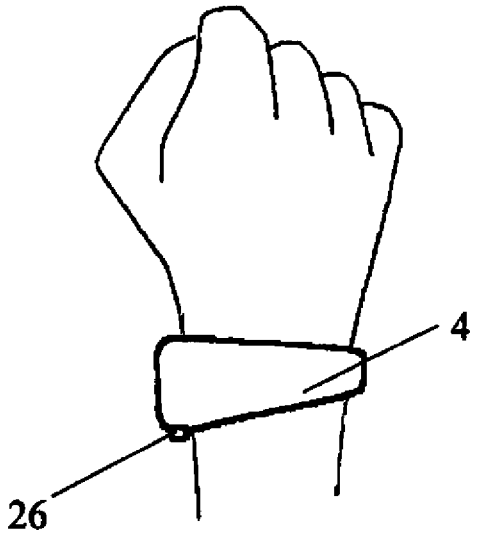
Figure 8:
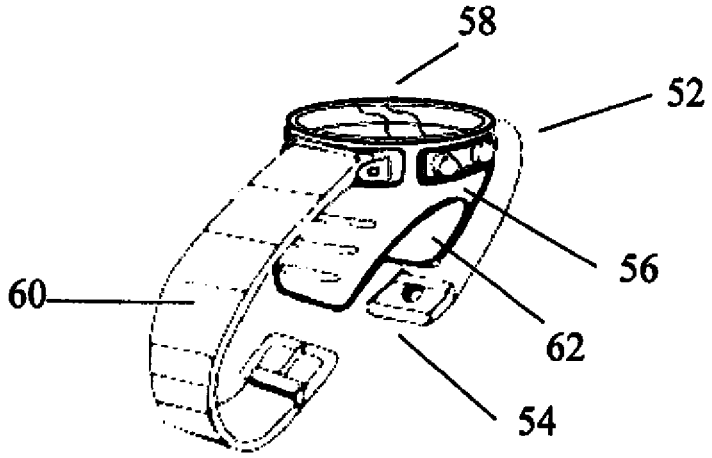
Figure 9:
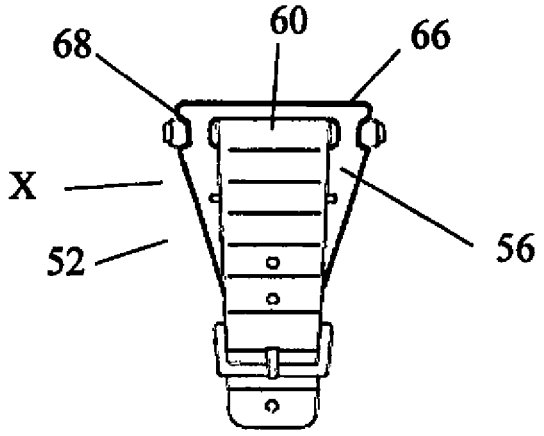
Figure 10:
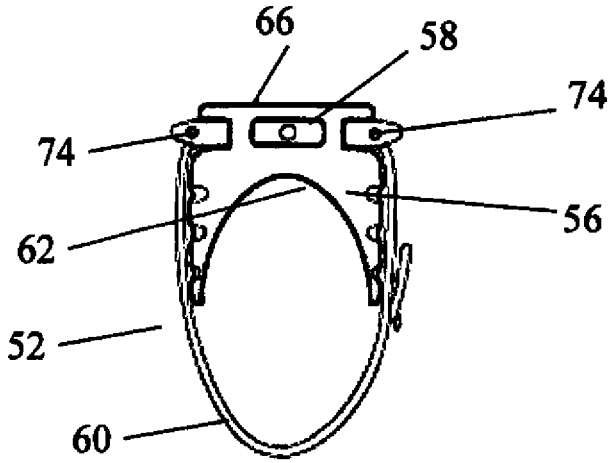
Figure 11:
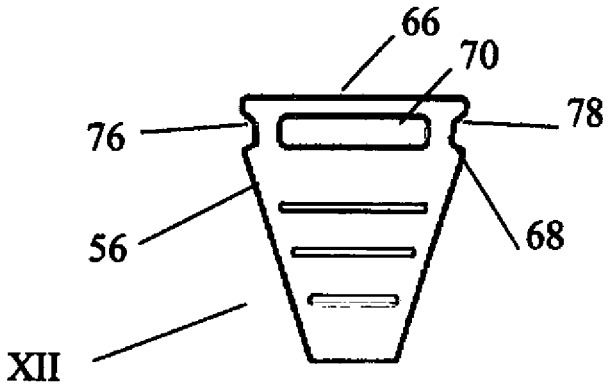
Figure 12:
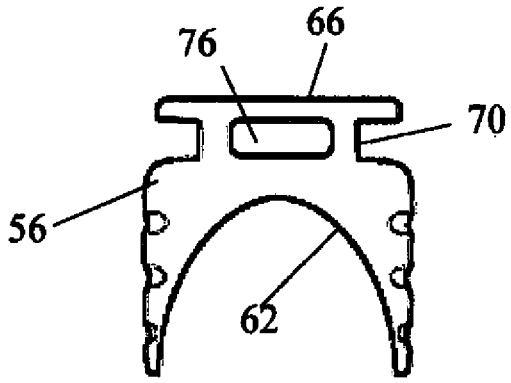
Figure 13:
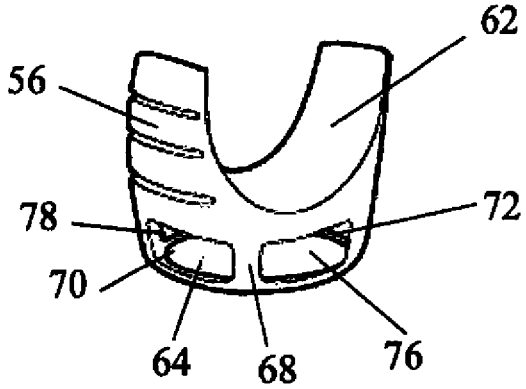
Figure 14:
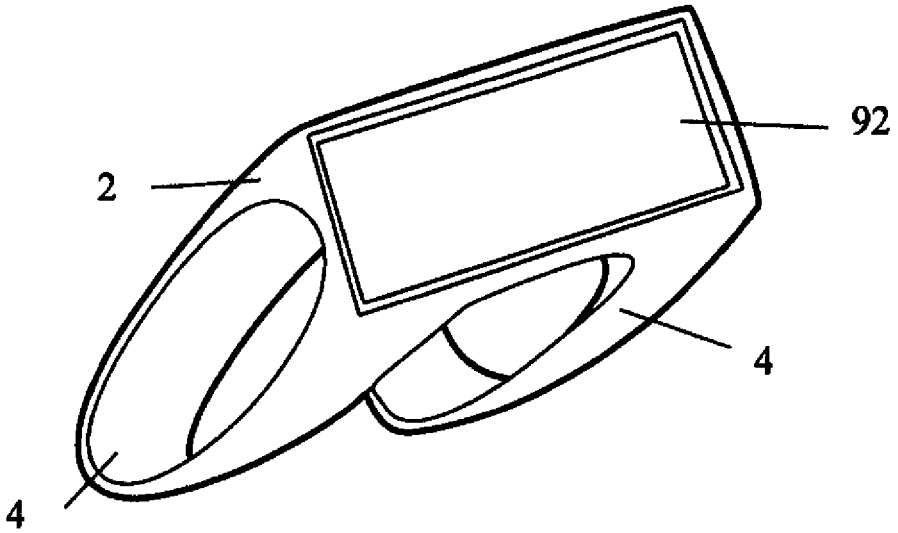
Figure 15:
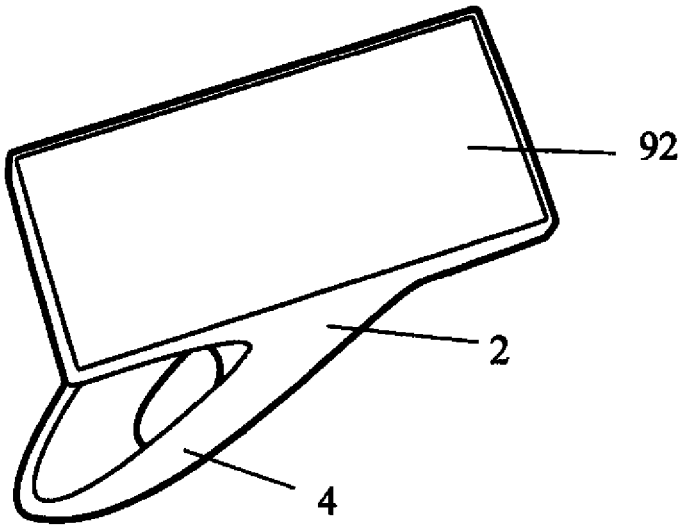
Figure 16:
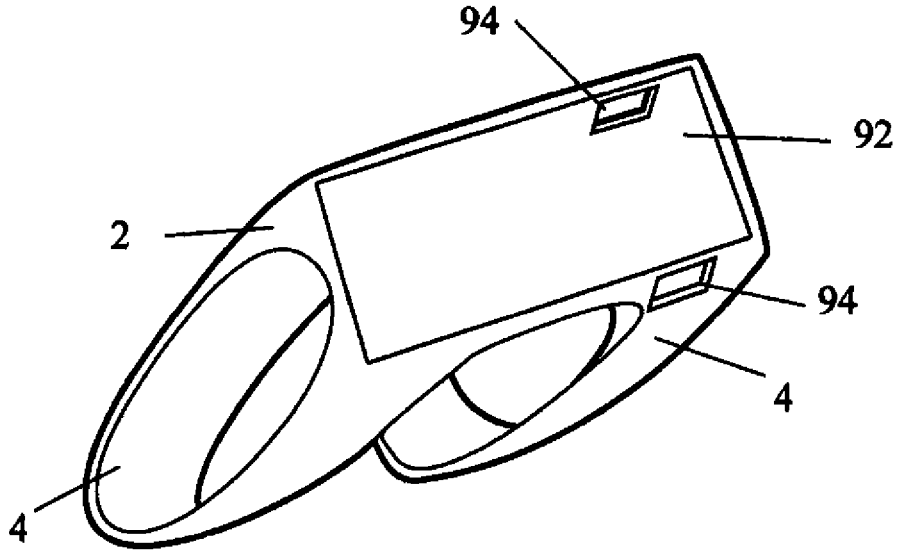
Figure 17:
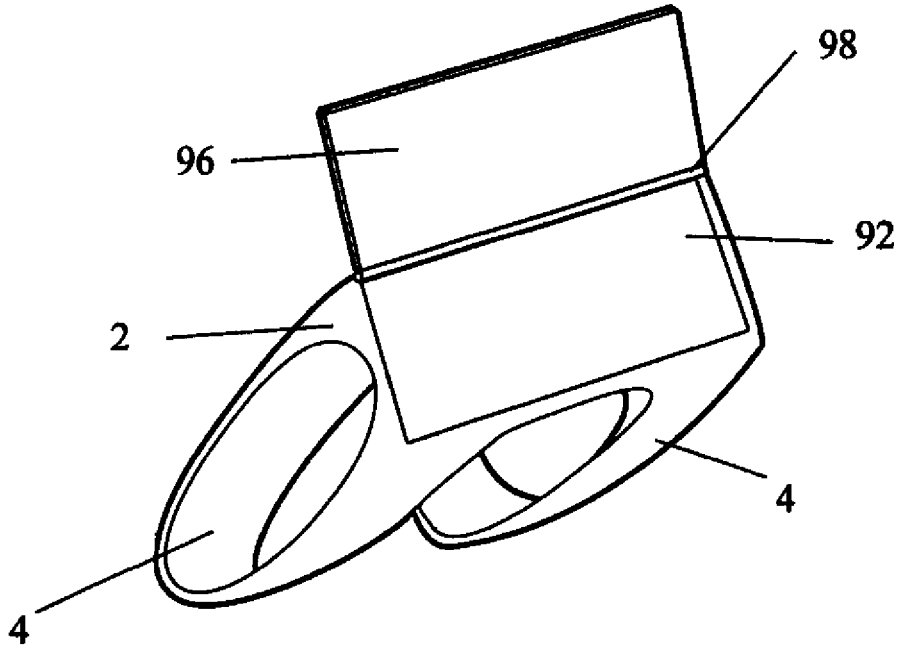
Figure 18:
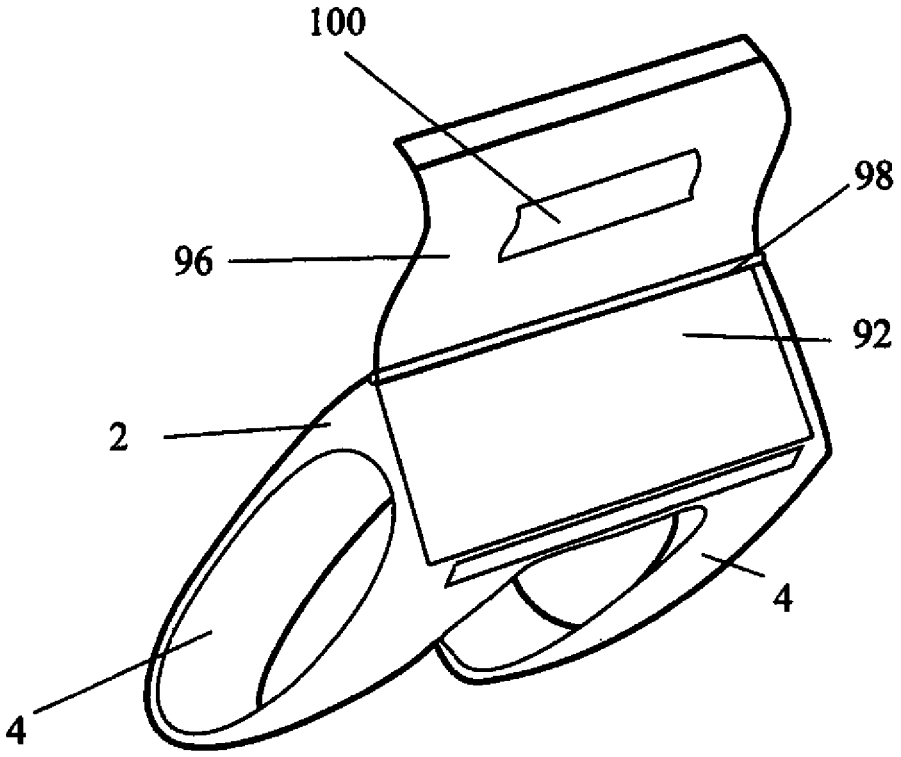

For a better understanding of the invention and to show how embodiments of the same may be carried into effect, reference will now be made, by way of example, to the accompanying diagrammatic drawings, in which:

FIG. 1 is an upper perspective view of a first wristband assembly of the present invention when configured to support a wristwatch;

FIG. 2 is a similar view to that of FIG. 1 but with the wristwatch removed;

FIG. 3 is a side view of the first wristband assembly showing one embodiment of a wristwatch being inserted into a wristband of the assembly;

FIG. 4 is a part section view of an upper end of the wristband assembly of FIG. 3 illustrating the insertion of a wristwatch into the wristband assembly;

FIG. 5 is a part section view corresponding to FIG. 4 and illustrating the position of a wristwatch upon insertion into the wristband of the wristband assembly;

FIG. 6 is an exploded view of a wristwatch of the present invention illustrating the assembly of a battery within the wristwatch housing;

FIG. 7 illustrates the hand of a wearer with a wristband assembly in an ergonomic position for ease of viewing the device;

FIG. 8 shows an upper perspective view of a second wristband assembly provided by the present invention;

FIG. 9 shows a side elevation of the second wristband assembly of FIG. 8;

FIG. 10 shows a plan view in the direction of the Arrow X of FIG. 9;

FIG. 11 shows a side elevation of a mounting of the wristband assembly of FIGS. 8 to 10;

FIG. 12 shows a front view in the direction of the Arrow XII of FIG. 11;

FIG. 13 shows an inverted perspective view of the mounting of FIGS. 11 and 12;

FIG. 14 shows an isometric view of a double-strap arrangement for the wristband assembly when configured to support a small device;

FIG. 15 shows the wristband assembly of FIG. 14, with a single-strap arrangement;

FIG. 16 shows the wristband assembly of FIGS. 14 and 15, comprising at least one hole for locating at least one control for the device;

FIG. 17 shows the wristband assembly of FIGS. 14 to 16, provided with one embodiment of a cover; and, FIG. 18 shows the wristband assembly of FIGS. 14 to 17, whereby the cover is provided with a viewing window.

DETAILED DESCRIPTION OF THE INVENTION

The present invention provides a first wristband assembly 2 generally comprising a wristband 4 and a wristwatch 6, see FIG. 1.

The wristband 4, which is moulded from a flexible rubberised plastic, is generally ovoid in shape, see FIG. 3, and comprises a central opening 8 for a wearer's hand when in use, see FIG. 7.

The wristband 4 also comprises an aperture 10 extending from an inner peripheral surface boundary 12 of the central opening 8, which aperture 10 extends through the wristband to a window 14 thereof, see FIGS. 1, 2, 4 and 5.

The wristband 4 further comprises an upper peripheral wall 16 and a lower peripheral wall 18 defining a spatial volume 20, see FIGS. 2, 4 and 5, into which spatial volume 20 the wristwatch 6 is inserted to complete the wristband assembly 2. In order to facilitate the insertion of the wristwatch 6 into the spatial volume 20 as aforesaid, a inner peripheral edge 24 of the lower peripheral wall 18 is readily deformed, as shown in FIG. 4.

The wristwatch 6 comprises a spigot 26, which is received into a through bore 28 provided in a sidewall 30 of the spatial volume 20 to act as a latch for securing the wristwatch 6 in situ, see FIGS. 2 and 3.

The wristwatch 6 embodied in the wristband assembly 2 is a digital wristwatch operated by a battery 32 that is inserted between upper and lower sections 34 and 36 of a casing 38 of the wristwatch 6, the battery 32 being located centrally of the lower section 36 on four arcuate, carrier posts 40, see FIG. 6.

As seen in FIG. 7, when a wearer of the wristband assembly 2 wishes to check the time, all they have to do is look down at the wristwatch 6 that is located on the inside of their wrist.

The present invention also provides a second wristband assembly 52 generally comprising a wristband 54 provided by a mounting 56 for a conventional wristwatch 58 having a watchstrap 60 for attachment about the wrist of a wearer.

The mounting 56, which is formed as a moulding from a rubberised plastic composition, is configured to conform to an inside edge of a wearer's wrist so that the wristwatch 58 is positioned for ease of viewing by the wearer when they need to know the time.

The mounting 56 comprises a curved under surface 62 and a recess 64 formed in an upper surface 66, which recess 64 is bounded by a wall 68, see FIGS. 11, 12 and 13. The wall 68 is provided with a first pair of opposed openings 70 and 72 for receiving, in use, watchstrap spindle means 74 by which the watchstrap 60 is attached to the wristwatch 58, see FIGS. 8, 9 and 10.

The wall 68 is also provided with a second pair of opposed openings 76 and 78 for location of winding and setting buttons 80 and 82, the two pairs of openings 70, 72 and 76, 78 being respectively arranged at right angles one to the other, see FIGS. 11, 12 and 13.

It will be apparent from the forgoing description that that the wearer of the wristband assembly 52 of FIGS. 8, 9 and 10 will be able to view the dial of the wristwatch 58, which is located on the side of their wrist by the mounting 56 and secured thereto by the conventional watchstrap 60.

While the present invention has been described as a wristband assembly incorporating circular wristwatches 6 and 58 in the first and second embodiments respectively, other shapes and configurations of wristwatch, such as oval, square or rectangular, may be accommodated in wristwatch assemblies of appropriate configurations.

In addition, while the wristwatch assemblies described herein have incorporated a digital wristwatch 6 and a conventional wind up wristwatch 58, other devices may be incorporated into the assemblies; for example, the devices may include an MP3 player, a stopwatch, a photo display unit, a radio, a calendar, personal organiser, games unit, small mobile phone, GPS maps unit, and the like devices all of which will have a chronological function in addition.

Further devices may include a 'runner's wristwatch', which may include a pulse monitor and a thermometer incorporated therein. One device may include a vibrating means or speaker to allow the wearer to feel a 'buzz' or hear a 'bleep' as part of an alert system, or for the purpose of keeping to a time or beat, as per a swimmer's strokes, a runner's steps, or even someone performing CPR.

The display on the side of the wrist of a wearer would be most advantageous for sports people, who could glance quickly at the dial of the device to determine their performance at any moment in time.

The wristband 4 of the first wristband assembly 2 and the mounting 56 of the second wristband assembly 52 may be produced in various colours, patterns and sizes to appeal to the various markets that are available for the young, not so young and the sporty type end users.

While the wristband 4 and the mounting 52 have been described as mouldings of rubberised plastic, it is envisaged that the composition thereof may usefully be a moulding of a polysiloxane that is flexible to enable the wristband 4 to be placed about a wearer's wrist and to be a comfortable fit against the wearer's skin.

The polysiloxane may be a suitable composition of silicone rubber.

Modifications to the wristband assembly of the present invention may include:

a) the wristwatch being held in place on the side of a wearers wrist by a non-custom, fitted cushion mounting;

b) the cushion mounting being fixed to, fused to or being part of the watch strap;

c) the cushion mounting may be made of rubberised plastic, silicon, leather or suede;

d) the cushion mounting could be held in place by the pins or the conventional fittings of the wristwatch housing and straps;

e) the wristwatch housing may include appropriate apertures for insertion of the wristwatch straps of a wristwatch;

f) the main battery for a digital wristwatch or other digital device may be located other than within the wristwatch or device casing, and be operatively connected to a smaller secondary battery within the wristwatch or device casing. The batteries may be rechargeable or alternatively replaceable. The connection may be through wireless or wired means;

g) appropriate shock proofing of the ergonomic wristband assembly may be provided;

h) the wristwatch may be a flip sided analogue/digital wristwatch; and, i) the wristwatch may be of any convenient configuration other than convention square, rectangular, round or oval.

FIG. 14 shows the wristband assembly 2 comprising a double wristband 4 arrangement for supporting larger devices onto the user's wrist. A fastening means 92 is configured to support a plurality of different small devices, and to mount these into position onto the side of the wrist. FIG. 15 shows a similar wristband assembly 2 but with just a single wristband 4 arrangement, to support the device onto the wrist. The fastening means 92 is again configured to support the device onto the side of the wrist.

As shown in FIG. 16, when the wristband assembly 2 is being used to support a small device, or a device larger than a typical wristwatch 6, said small devices tend to incorporating at least one button or control means about the periphery of the device.

The fastening means 92 for the small device must therefore incorporate at least one hole 94 that coincides with a button or control means for a particular small device, to allow access to the control means for the device when the small device is in situ within the wristband assembly 2. The holes 94 may also allow a wearer to gain access to locking system to allow the wearer to lock and unlock the screen usage for the device, to prevent accidental use should the device become knocked when in situ within the wristband assembly 2.

FIG. 17 shows a further alternative to the locking means for preventing a small device from being used accidentally, and comprises a cover 96 that is hingedly connected through a hinge 98 to the fastening means 92 of the wristband assembly 2.

The cover 96 covers the screen of the small device. The cover 96 may be rigid in construction, or may be made from a flexible material. The cover 96 can be easily and conveniently lifted out of the way of the interface of the small device when required. The cover 96 also protects a screen or interface of the device when in a deployed position.

FIG. 18 shows a further embodiment of the cover 96, provided with a window 100 to allow at least a portion of the small device to remain viewable or useable when the cover 96 is in a closed or deployed position. The cover 96 may comprise more than one window 100, not shown.

Other modifications are envisaged within the scope of the invention described and claimed herein.

The invention claimed is:

1. A mounting for supporting a device on a lateral side of a wrist, the mounting comprising:

at least one distal forearm engaging portion made as an integral part of a casing of a device; and at least one fastener also made as an integral part of the mounting for securing a remainder of the device to the mounting, wherein:

the at least one distal forearm engaging portion comprises a lower peripheral wall for placement on a wrist of a wearer and between the wrist and a recess of the at least one fastener;

the at least one distal forearm engaging portion is formed from a flexible, non-custom fitted material to have a curved under surface that securely conforms to an inside edge of the wrist; and the at least one distal forearm engaging portion occupies a space below the device, above lateral aspects of the distal forearm, and between an anterior paracoronal plane of the distal forearm and a posterior paracoronal plane of the distal forearm.

2. The mounting of claim 1, wherein the fastener is provided with at least one opening for receiving at least one control means of the device.

3. The mounting of claim 1, wherein the fastener comprises an aperture defined by a peripheral edge of a peripheral wall.

4. The mounting of claim 1, wherein the least one distal forearm engaging portion is formed from a silicone rubber.

5. The mounting of claim 4, wherein the silicone rubber comprises polysiloxane.

6. The mounting of claim 1, wherein the mounting is configured to support at least one of a wristwatch, a stopwatch, a radio, a games unit, a pulse monitor, and a thermometer, a mobile phone, a smartphone, a Personal Digital Assistant, an MP3 player, a GPS unit, or a touchscreen device.

7. The mounting of claim 1, wherein the mounting is configured to support a device other than a conventional square, rectangular, round, or oval device.

8. The mounting of claim 1, wherein the mounting further comprises a cover for covering a surface of the device.

9. A mounting for supporting a device on a lateral side of a wrist, the mounting comprising:

at least one distal forearm engaging portion made as an integral part of at least one wristband; and at least one fastener also made as an integral part of the mounting, the at least one distal forearm engaging portion, and the at least one wristband for securing the device to the mounting, wherein:

the at least one distal forearm engaging portion comprises a lower peripheral wall for placement on a wrist of a wearer and between the wrist and a recess of the at least one fastener;

the at least one distal forearm engaging portion is formed from a flexible, non-custom fitted material to have a curved under surface that securely conforms to an inside edge of the wrist; and the at least one distal forearm engaging portion occupies a space below the device, above lateral aspects of the distal forearm, and between an anterior paracoronal plane of the distal forearm and a posterior paracoronal plane of the distal forearm.

10. The mounting of claim 9, wherein the fastener is provided with at least one opening for receiving at least one control means of the device.

11. The mounting of claim 9, wherein the mounting is made separately from the at least one wristband.

12. The mounting of claim 9, wherein the mounting is configured to allow the device to be interchangeable with another device.

13. The mounting of claim 9, wherein the least one distal forearm engaging portion is formed from a silicone rubber.

14. The mounting of claim 13, wherein the silicone rubber comprises polysiloxane.

15. The mounting of claim 9, wherein the mounting is configured to support at least one of a wristwatch, a stopwatch, a radio, a games unit, a pulse monitor, and a thermometer, a mobile phone, a smartphone, a Personal Digital Assistant, an MP3 player, a GPS unit, or a touchscreen device.

16. The mounting of claim 9, wherein the mounting is configured to support a device other than a square, rectangular, round, or oval device.

17. The mounting of claim 9, wherein the mounting further comprises a cover for covering a surface of the device.

* * * * *